US012624636B2

(12) United States Patent
Taylor

(10) Patent No.: US 12,624,636 B2
(45) Date of Patent: May 12, 2026

(54) APPARATUS AND METHOD FOR CONTACTING AN OPEN HOLE SURFACE

(71) Applicant: Expro North Sea Limited, Dyce (GB)

(72) Inventor: Samuel Keith Taylor, Eastleigh (GB)

(73) Assignee: Expro North Sea Limited, Dyce (GB)

( * ) Notice: Subject to any disclaimer, the term of this patent is extended or adjusted under 35 U.S.C. 154(b) by 240 days.

(21) Appl. No.: 17/772,607

(22) PCT Filed: Oct. 28, 2020

(86) PCT No.: PCT/EP2020/080228
§ 371 (c)(1),
(2) Date: Apr. 28, 2022

(87) PCT Pub. No.: WO2021/083927
PCT Pub. Date: May 6, 2021

(65) Prior Publication Data

US 2023/0003117 A1 Jan. 5, 2023

(30) Foreign Application Priority Data

Oct. 28, 2019 (GB) ..... 1915617

(51) Int. Cl.
*E21B 47/125* (2012.01)
*E21B 33/12* (2006.01)

(52) U.S. Cl.
CPC ..... *E21B 47/125* (2020.05); *E21B 33/1208* (2013.01)

(58) Field of Classification Search
CPC ... E21B 33/1208; E21B 33/127; E21B 47/125
See application file for complete search history.

(56) References Cited

U.S. PATENT DOCUMENTS

| | | | | |
|---|---|---|---|---|
| 2,732,525 | A | 1/1956 | Blanchard | |
| 3,379,963 | A * | 4/1968 | Saurenman | G01V 3/20 324/374 |
| 3,411,587 | A * | 11/1968 | Bournazel | E21B 49/082 166/165 |
| 2002/0189821 | A1 | 12/2002 | Watson | |
| 2005/0199401 | A1 | 9/2005 | Patel | |
| 2007/0151724 | A1 | 7/2007 | Ohmer | |
| 2011/0284216 | A1 | 11/2011 | Addis | |
| 2012/0055669 | A1 | 3/2012 | Levin | |
| 2013/0213645 | A1* | 8/2013 | Proett | E21B 49/088 166/264 |
| 2014/0111347 | A1* | 4/2014 | Slapal | E21B 49/088 340/854.6 |
| 2015/0219783 | A1 | 8/2015 | Sitka | |
| 2016/0024897 | A1* | 1/2016 | Greci | E21B 43/108 166/227 |
| 2017/0254194 | A1 | 9/2017 | Mazyar | |
| 2018/0252100 | A1 | 9/2018 | Ranjan | |

* cited by examiner

*Primary Examiner* — Tara Schimpf
*Assistant Examiner* — Lamia Quaim

(57) ABSTRACT

An apparatus and method for contacting an open hole surface are provided. The apparatus includes an expandable portion surrounded by a contact portion configured to contact an open hole surface. The method includes expanding an expandable portion surrounded by a contact portion to create contact between the contact portion and an open hole surface.

6 Claims, 9 Drawing Sheets

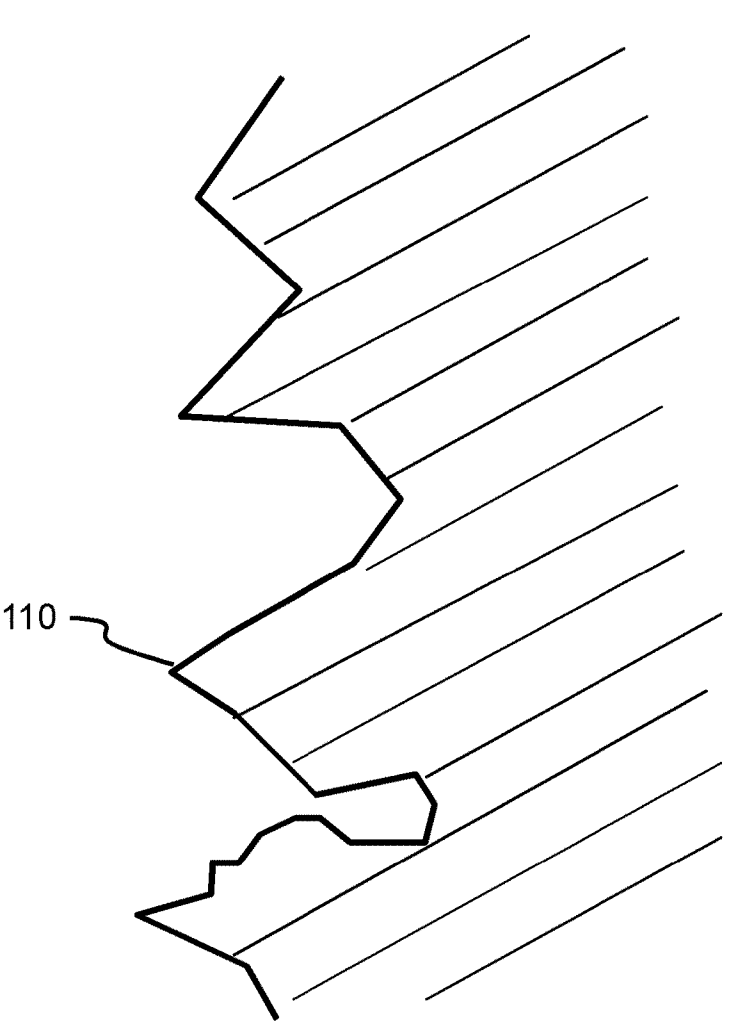
Figure 2
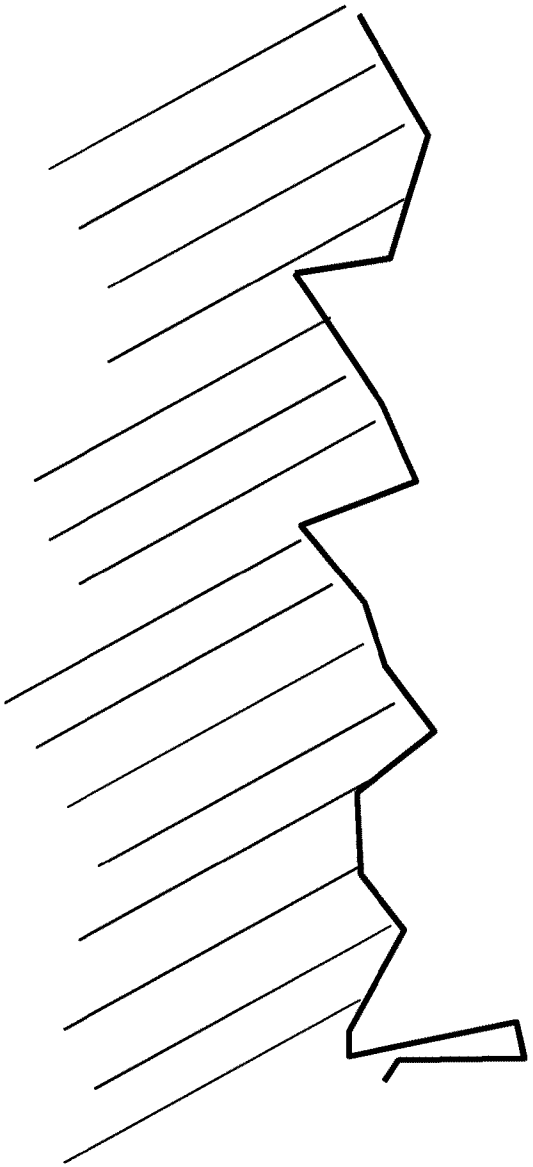

APPARATUS AND METHOD FOR CONTACTING AN OPEN HOLE SURFACE

This application claims priority to PCT Patent Appln. No. PCT/EP2020/080228 filed Oct. 28, 2020, which claims priority GB Patent Appln. No. 1915617.3 filed Oct. 28, 2019, which are herein incorporated by reference.

BACKGROUND OF THE INVENTION

1. Technical Field

Some described examples generally relate to open hole environments, and in particular, to apparatus and methods for contacting an open hole surface.

2. Background Information

Either when a well is drilled/completed, or at some point later in the life cycle of a well, sections of the well infrastructure may be uncased or without liner. That is to say that that the well infrastructure may comprise regions that are "open hole". Such open hole regions may exist in a pilot hole, sidetrack, or otherwise at the bottom of a well structure without a liner (e.g. an open hole or barefoot completion).

Open hole sections may exist in onshore and offshore wells. It will be appreciated that the surface or ground region associated with an onshore well may relate to the surface from which the well structure extends into ground and then down to the formation. For an offshore well, the surface or ground region may relate to the mudline, or the like, from which well structure extends down to the formation below.

In addition, a particular type of well is an appraisal (or exploration) well which may be drilled as part of an appraisal process to determine the extent and reserves at a particular field. Appraisal wells may be present at onshore and offshore locations. Appraisal wells may comprise a section having a metallic well structure, such as a conductor or casing, and an open hole section having no metallic well structure. Once the appraisal process is complete, appraisal wells are typically abandoned. The abandonment process may include pumping a first plug, which may comprise cement, into the open hole section and positioning a second plug, which may also comprise cement in the metallic well structure section.

Further, at the end of the lifecycle of a well, or at the end of an appraisal process, or the like, steps may be taken to permanently abandon a well that may introduce open hole regions. Abandonment procedures may include: isolating any freshwater zones associated with the well; isolating from the well any future production zones; preventing leaks to/from the well; and, in addition to removing wellheads, etc., also cutting and removing all well structure such as casing strings, etc., to a particular level below the surface.

Communication methods in the oil in gas industry may utilize e-lines, slicklines, fibre optic cabling, electromagnetic technology, acoustic technology and pressure wave technology. However, one or more of these technologies may be problematic to implement in the described open hole regions.

This background serves only to set a scene to allow a person skilled in the art to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

In some examples, an apparatus for contacting an open hole surface is provided. The apparatus provides for robust and effective contact to an open hole surface.

In some examples, the apparatus comprises an expandable portion surrounded by a contact portion configured to contact an open hole surface.

An open hole surface, in contrast with a cased or tubed surface, of a formation is not generally smooth. An open hole surface may have bumps, cracks, fractures, gaps, holes and other such generally uneven and/or not smooth surfaces. These uneven surfaces have a reduced surfaced area that may be contact by a flat or even contact portion.

Accordingly, the expandable portion is configured to expand to force the contact portion to contact the open hole surface. Expansion of the expandable portion forces the contact portion to at least partially fill the bumps, cracks, fractures, gaps, holes and other generally uneven and/or not smooth surfaces of the open hole surface. Expansion of the expandable portion generally increases the surface area of the open hole portion that the contact portion is contacting. As will be described, this reduces resistance to ground and improves signal transmission and reception.

While the contact portion may contact the open hole surface prior to expansion of the expandable portion, expansion of the expandable portion increases the surface area of the open hole surface that is contacted by the contact portion.

In some examples, the contact portion is configured to maximize contact with the open hole surface. Once the expandable portion has expanded the contact portion maximizes contact with the open hole surface.

As previously stated, the contact portion may contact the open hole surface prior to expansion of the expandable portion; however, expansion of the expandable portion maximizes the surface area of the open hole surface that is contacted by the contact portion.

In some examples, the contact portion is configured to electrically contact the open hole surface.

The apparatus may be used in transmitting or receiving signals through the formation. In order to transmit and receive signals through the formation, electrical contact with the open hole surface of the formation may be required. For example, transmitting and receiving signals via electromagnetic or acoustic signals through the formation may require electrical contact with the open hole surface. Accordingly, the contact portion is configured to electrically contact the open hole surface.

In some examples, the contact portion is configured to minimize resistance to ground through the open hole surface.

Increasing or maximizing contact with the open hole surface minimizes resistance to ground through the open hole surface. This reduces resistance seen by the apparatus in transmitting a signal through the formation or receiving a signal transmitted through the formation. Therefore, signals can be transmitted/received over greater distances and/or with greater certainty of accurate and correct reception.

In some examples, the expandable portion comprises at least one inflatable bladder.

In some examples, the expandable portion comprises an inflatable bladder on each end of the apparatus.

Each bladder is configured to be pressurized or inflated. Each bladder is surrounded by the contact portion. When a bladder is pressurized or inflated (i.e. expanded state), the bladder increases the diameter of the contact portion. The bladders and contact portion are sized and positioned such that this increased diameter forces the contact portion into contact with the open hole surface and increases the surface area of the open hole surface that the contact portion contacts. When a bladder is de-pressurized or deflated (i.e. resting state), the bladder decreases the increased diameter of the contact portion back to its original resting diameter.

In some or more examples, the expandable portion comprises a swellable member configured to swell on contact with a particular fluid. Despite the contact portion surrounding the expandable portion, the fluid may still contact the swellable member. For example, the contact portion may have gaps or apertures. In some or more examples, the contact portion comprises a sleeve.

The swellable member is configured to swell upon contact with a particular fluid to increase the diameter of the contact portion and increase the surface area of the open hole portion that is contacted by the contact portion. The particular fluid may be production fluid or a particular trigger injected into production or other fluid.

In some or more examples, the swellable member comprises an elastomer. Exemplary elastomers include a superabsorbent polymer (SAP). The SAP is configured to swell upon contact with water.

In some or more examples, the expandable portion comprises a member configured to buckle outwards upon compression.

The member is longitudinally compressed (i.e. compressed along its long axis) such that the member is forced to buckle outwards (i.e. radially) by the compression. The contact portion surrounds the member such that the outwards buckling of the member causes the contact portion to contact the open hole surface. Thus, during compression of the member an increased surface area of the open hole surface contacts the contact portion. Once the member is no longer compressed, the member will return to its original uncompressed state and unbuckled state.

The member may be compressed on both ends or on only a single end. The member may be compressed by a piston. The piston may be motor driven.

In some or more examples, the member is tubing. In some examples, the tubing is a polymer.

In some or more examples, the expandable portion is configured to receive fluid.

In some or more examples, the fluid is production fluid.

In some of more examples, the expandable portion comprises at least one expandable pocket configured to receive fluid. The expandable pocket receives fluid, such as production fluid. The fluid expands the pocket towards the open hole surface. The expanded pocket forces the contact portion to contact more of the open hole surface than when the pocket is not expanded.

In some or more examples, the apparatus further comprises a valve configured to permit fluid to flow into and/or out of the pocket. The valve may be opened to release any fluid in the pocket. The valve may be a non-return valve. A non-return valve ensures that fluid flows out of the pocket and not back into the pocket through the non-return valve.

In some or more examples, the expandable portion comprises at least one valve configured to receive fluid. The valve may form part of a series of valves configured to receive fluid. The valves receive fluid, such as production fluid. The received fluid put pressure on the contact portion pushing the contact portion to contact more of the open hole surface.

In some or more examples, the contact portion a sleeve. The sleeves surround the expandable portion.

Upon expansion of the expandable portion, the sleeve contacts the open hole surface. An increased surface area of the open hole surface contacts the sleeve when the expandable portion is expanded compared to when the expandable portion is not expanded.

The sleeve may be made of an electrically conductive material. The increased surface area allows for lower resistivity to be seen by the sleeve when receiving or transmitting signals through the open hole surface from or into, respectively, the formation.

In some or more examples, the contact portion comprises a mesh.

Upon expansion of the expandable portion, the mesh contacts the open hole surface. An increased surface area of the open hole surface contacts the mesh when the expandable portion is expanded compared to when the expandable portion is not expanded.

The mesh may be made of an electrically conductive material. In particular, the mesh may be formed of interwoven conductive fibres. The increased surface area allows for lower resistivity to be seen by the mesh when receiving or transmitting signals through the open hole surface from or into, respectively, the formation.

In some or more examples, the contact portion comprises a tube of rope.

Upon expansion of the expandable portion, the tube of rope contacts the open hole surface. An increased surface area of the open hole surface contacts the tube of rope when the expandable portion is expanded compared to when the expandable portion is not expanded.

The tube of rope may be made of an electrically conductive material. The increased surface area allows for lower resistivity to be seen by the tube of rope when receiving or transmitting signals through the open hole surface from or into, respectively, the formation.

In some or more examples, the rope comprises braided steel rope.

In some or more examples, the apparatus is configured to at least one of transmit and receive a signal. The signal may be transmitted or received through the formation via the open hole surface. Upon expansion of the expandable portion, the contact portion contacts an increased surface area of the open hole surface. Increasing the surface area of the open hole surface contacted decreases or minimizes the resistance seen by the contact portion. The decreased or minimized resistance ensures current may be successfully retrieved (or pulled) from the formation via the open hole surface for receiving signals, and ensures current may be successfully transmitted (or pushed) into the formation via the open hole surface. This increases the transmission distance to the apparatus or from the apparatus. Furthermore, this increases the reliability of transmission and reception.

In some examples, the apparatus is configured for use in a sidetrack of a well.

A sidetrack is a secondary wellbore drilled away from the original well. It is possible to have multiple sidetracks, each of which may have been drilled for different reasons. The sidetrack may be unused. Specifically, the sidetrack may be unused for collecting production fluid. Use of the apparatus in a sidetrack that is not used for collecting production fluid ensures that the apparatus does not restrict the flow and/or collection of production fluid.

In one example, a method for contacting an open hole surface is provided. The method provides for robust and effective contact to an open hole surface.

In some examples, the method comprises expanding an expandable portion surrounded by a contact portion to create contact between the contact portion and an open hole surface.

As previously stated, an open hole surface, in contrast with a cased or tubed surface, of a formation is not smooth. An open hole surface may have bumps, cracks, fractures, gaps, holes and other such generally uneven and/or not smooth surfaces. Uneven and not smooth surfaces have a reduced surfaced area that may be contact by a flat or even contact portion.

Expansion of the expandable portion surrounded by the contact portion forces the contact portion to contact the open hole surface. The contact portion may partially fill the bumps, cracks, fractures, gaps, holes and other such generally uneven and/or not smooth surfaces of the open hole surface. Further, the contact portion contacts a greater surface area of the open hole portion than when the expandable portion is not expanded. This reduces resistance to ground and improves signal transmission and reception.

While the contact portion may contact the open hole surface prior to expansion of the expandable portion, expansion of the expandable portion increases the surface area of the open hole surface that is contacted by the contact portion.

In some or more examples, the contact between the contact portion and the open hole surface is electrical contact.

Electrical signals may be injected, transferred or pushed, or detected, extracted or pulled into/from the formation via the electrical contact between the open hole surface and the contact portion. As a greater surface area of the open hole surface is contacted when the expandable portion is expanded than when the expandable portion is not expanded or resting, the electrical contact has a lower resistance. The lower resistance seen by the contact portion allows for signals to be transmitted/received over greater distances and/or with greater certainty of accurate and correct reception.

In some or more examples, expanding the expandable portion surrounded by the contact portion minimizes resistance to ground through the open hole surface.

Minimizing the resistance to ground through the open hole surface ensures signals can be received from the formation and transmitted to the formation via the open hole surface at lower power rates. This may increase the life cycle of the apparatus. An increased life cycle results in a longer lasting apparatus that does not require as large batteries or requires fewer battery changes. This is particularly relevant in abandonment of wells where signal retrieval and transmission may be required for a significant time period.

In some or more examples, expanding the expandable portion comprises inflating at least one bladder.

Each bladder is configured to be pressurized or inflated. Each bladder is surrounded by the contact portion. When a bladder is pressurized or inflated (i.e. expanded state), the bladder increases the diameter of the contact portion. The bladders and contact portion are sized and positioned such that this increased diameter forces the contact portion into contact with the open hole surface and increases the surface area of the open hole surface that the contact portion contacts. When a bladder is de-pressurized or deflated (i.e. resting state), the bladder decreases the increased diameter of the contact portion back to its original resting diameter.

In some or more examples, expanding the expandable portion comprises using fluid to expand the expandable portion. The fluid comprises a liquid or a gas. In some examples, the fluid is pumped into the expandable portion to pressurize the expandable portion and cause the expandable portion to expand.

In some or more examples, expanding the expandable portion comprises receiving fluid and using the received fluid to expand the expandable portion. The fluid comprises a liquid or a gas. In some examples, the fluid is received by the expandable portion via a valve. The fluid is pumped into the expandable portion to pressurize the expandable portion and cause the expandable portion to expand.

In some or more examples, the fluid is production fluid.

The fluid may be received by an expandable pocket of the expandable portion. The expandable pocket receives fluid. The fluid expands the pocket towards the open hole surface. The expanded pocket contacts more of the open hole surface than then the unexpanded pocket.

The fluid may be received by at least one valve configured to receive fluid. The valve may form part of a series of valves configured to receive fluid. The valves receive fluid. The received fluid put pressure on the contact portion pushing the contact portion to contact more of the open hole surface.

In some or more examples, expanding the expandable portion comprises swelling a swellable member. In some or more examples, the swellable member comprises an elastomer.

The swellable member is configured to swell upon contact with a particular fluid to increase the diameter of the contact portion and increase the surface area of the open hole portion that is contacted by the contact portion. The particular fluid may be production fluid or a particular trigger injected into production or other fluid.

In some or more examples, the elastomer is a superabsorbent polymer (SAP). The SAP is configured to swell upon contact with water.

In some or more examples, the method further comprises, prior to expanding the expandable portion, passing the expandable portion surrounded by the contact portion through a well to the open hole surface.

The expandable portion is in a deflated or non-expanded state and therefore the expandable portion surrounded by the contact portion can pass through the restricted diameter of the well. However, when the expandable portion surrounded by the contact portion reaches the open hole surface, the expandable portion expands and the contact portion contacts the open hole surface. The overall diameter of the expandable portion surrounded by the contact portion is now greater than in the deflated state. The expandable portion surrounded by the contact portion can therefore pass through restricted diameter entry points, such as a well, while still expanding to contact an open hole surface.

Aspects of the inventions described may include one or more examples, embodiments or features in isolation or in various combinations whether or not specifically stated (including claimed) in that combination or in isolation.

BRIEF DESCRIPTION OF THE DRAWINGS

A description is now given, by way of example only, with reference to the accompanying drawings, in which:

FIG. 2 is an enlarged elevation view of the open hole section of the well of FIG. 1;

DETAILED DESCRIPTION OF THE INVENTION

Figure 1:
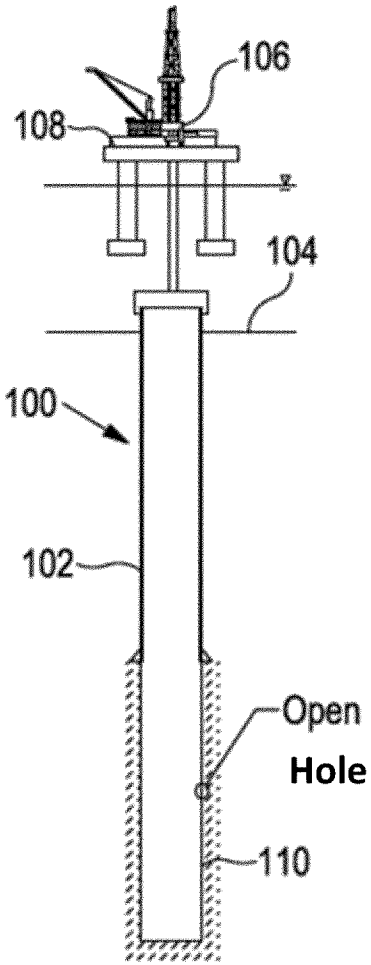
FIG. 1 is a simplified representation of a section of a well.

The foregoing summary, as well as the following detailed description of certain embodiments will be better understood when read in conjunction with the accompanying drawings. As will be appreciated, like reference characters are used to refer to like elements throughout the description and drawings. As used herein, an element or feature recited in the singular and preceded by the word "a" or "an" should be understood as not necessarily excluding a plural of the elements or features. Further, references to "one example" or "one embodiment" are not intended to be interpreted as excluding the existence of additional examples or embodiments that also incorporate the recited elements or features of that one example or one embodiment. Moreover, unless explicitly stated to the contrary, examples or embodiments "comprising", "having" or "including" an element or feature or a plurality of elements or features having a particular property might further include additional elements or features not having that particular property. Also, it will be appreciated that the terms "comprises", "has" and "includes" mean "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of describing the relationship of an element or feature to another element or feature as depicted in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, or within less than 0.01% of the stated amount.

Some of the following examples have been described specifically in relation to well infrastructure relating to oil and gas production, or the like, but of course the systems and methods may be used with other well structures. Similarly, while in the following example an offshore well structure is described, nevertheless the same systems and methods may be used onshore, as will be appreciated.

Turning now to FIG. 1, a simplified representation of a section of a well 100 is shown. In this embodiment, the well 100 is an offshore appraisal well. A well structure 102 extends from the surface to a subterranean formation. In this embodiment, the surface is the seabed or mudline 104. The well structure 102 may comprise a conductor, casing and other tubing used to recover product from the subterranean formation. The well 100 further comprises a wellhead 106, wet tree or the like, at a production platform 108. In other embodiments, the wellhead 106 is located at the mudline 104. The well 100 further comprises an open hole section 110, in that there is no well structure positioned within the well 100 in the open hole section 110. While the open hole section 110 is lower than the well structure 102, a person skilled in the art will appreciate that other configurations are possible. The open hole section 110 may instead be located above the well structure 102.

As a person skilled in the art will appreciate, one or more devices may be present in the open hole section 110. Exemplary devices include down hole tools, gauges and sensors. Communication with or from these devices may be desired. Communication may be in the form of wireless communication. As used herein, the term "wireless" when applied to communications encompasses all transmission that is not through a guided transmission medium, such as a wire, other metallic structure or a material having high electromagnetic (EM) conductivity relative to a surrounding medium. Wireless communications may, for example, be through air, water, ground (or formation) or another medium that has substantially isotropic EM conductivity.

As previously stated, wireless communications may be through ground such as the subterranean formation itself. Detection of wireless communications through the subterranean formation may require contact with the subterranean formation. However, reliable contact may be problematic as the subterranean formation may have cracks, fractures, bumps, gaps and other such generally uneven or not smooth surfaces. Such unreliable contact may be present, in particular, at the open hole section 110.

Furthermore, evening these surfaces increases costs, time and may be impractical if the surfaces are downhole.

Turning now to FIG. 2, a side elevation view of the enlarged open hole section 110 is shown. As shown in FIG. 2, the surface of the open hole section 110 has cracks, fractures, bumps, gaps and other such generally uneven or not smooth surfaces. Reliable contact with such an uneven surface may be problematic.

Further, even if the open hole surface is reliably contacted, a lesser surface area of the open hole surface may be contacted compared to an even surface such as that from a tube or casings. This is due to the nature of the uneven surface of the open hole section 110.

Uneven surfaces may result in not at all of the current being transmitting (transferred or pushed) or received (detected or pulled) at the surfaces of the subterranean formation. If the current is not transmitted into the formation, then the resulting signal may be incorrectly and/or inaccurately wirelessly transmitted through the formation. Similarly, if the current is not received from the formation, then signals may be incorrectly and/or inaccurately wirelessly received through the formation.

In addition, uneven surfaces increase the resistivity to ground making transmission (transfer or pushing) and reception (detection or pulling) of current less effective and/or more power intensive. Therefore, transmission of current into an even surface allows the resulting signal to be sent over a greater distance than transmission of current into an uneven surface. Similarly, reception of current from an even surface allows signals to be sent over a greater distance than reception of current from an uneven surface.

Figure 3:
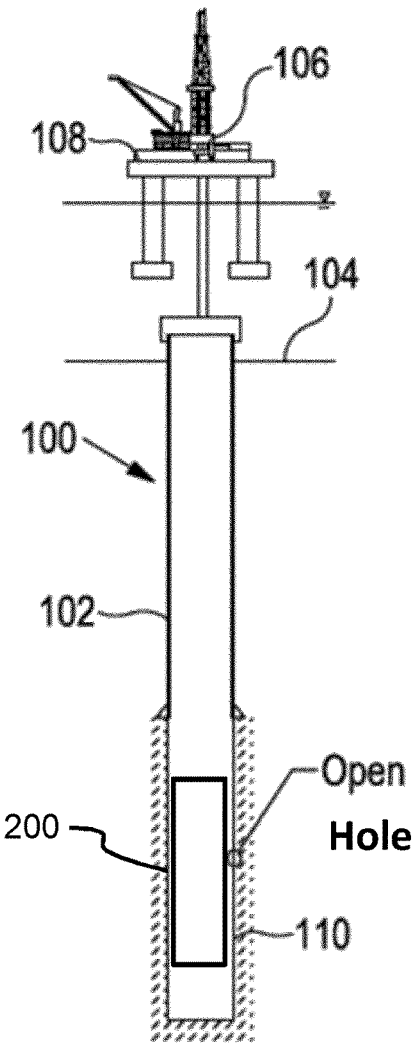
FIG. 3 is a simplified representation of the well of FIG. 1 with an apparatus for contacting an open hole surface in accordance with an aspect of the disclosure.

Turning now to FIG. 3, the well 100 of FIG. 1 is shown with an apparatus generally identified by reference numeral 200. The apparatus 200 is configured for contacting an open hole surface. In this embodiment, the apparatus 200 is positioned within the open hole section 110.

Figure 4:
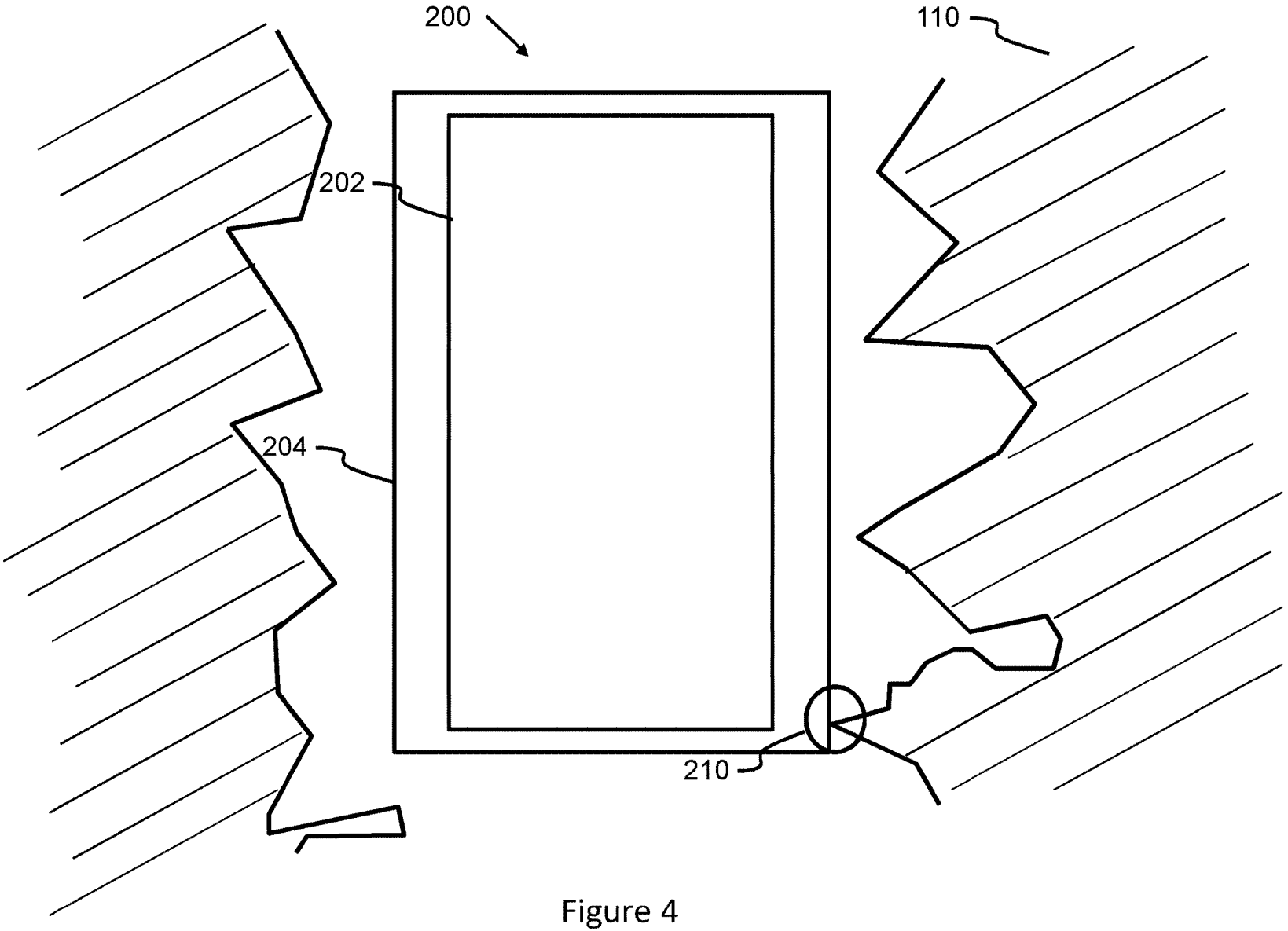
FIG. 4 is an enlarged elevation view of the open hole section of the well of FIG. 1 with the apparatus for contacting an open hole surface an unexpanded or resting state.

An enlarged view of the apparatus 200 is shown in FIG. 4. FIG. 4 is a side elevation view of the enlarged open hole section 110 with the apparatus 200. In this embodiment, the apparatus 200 is positioned within the open hole section 110. The apparatus 200 is configured for contacting an open hole surface, specifically a surface of the open hole section 110.

The apparatus 200 is sized such that it may be placed within the open hole section 110. Further, the apparatus 200 may be held in position within the open hole section 110 by a variety of methods including by some form of one or more of a packer, anchor, hook or platform.

While the apparatus 200 open hole section 110 has been shown in an offshore appraisal well, a person skilled in the art will appreciate that the apparatus 200 may be used in a variety of other wells in other environments including, but not limited to, offshore, onshore, appraisal wells, production wells, abandonment environments and combinations thereof.

As shown in FIG. 4, the apparatus 200 comprises an expandable portion 202 generally surrounded by a contact portion 204. The contact portion 204 may surround the entirety of the expandable portion 202 or only a portion thereof. The contact portion 202 is configured to contact an open hole surface.

The expandable portion 202 is configured to expand. Expansion of the expandable portion 202 forces the contact portion 202 to contact an open hole surface of the open hole section 110 as will be described.

The contact portion 204 is configured to contact an open hole surface of the open hole section 110. The contact portion 204 is configured to facilitate electrical contact between the apparatus 200 and the open hole section 110. For example, the apparatus 200 or the contact portion 110 may be connected to a device such as for example a transmitter, receiver, transceiver and/or processor that facilitates the transmission and/or reception of signals. The contact portion 204 provides electrical connection between the device and the open hole surface of the open hole section 110.

As shown in FIG. 4, the apparatus 200 may be in contact with the open hole section 110 when the expandable portion 202 is not expanded or in a resting state. Specifically, the contact portion 204 may be in contact with an open hole surface of the open hole section 110. However, since the open hole surface is generally uneven or not smooth and may have bumps, cracks, fractures, gaps and/or holes, the contact portion 204 may contact only a very small unexpanded proportion 210 of the open hole surface.

As the contact portion 204 may provide electrical contact to the open hole section 110 through the unexpanded proportion 210 of the open hole surface, the resistance, i.e. the resistance to ground, seen by the contact portion 204 (and any device contacted to the contact portion 204 or apparatus 200) may be extremely high if the unexpanded proportion 210 is very small. This will make sending, transmitting, transferring or pushing current in order to transmit a signal into the formation via the open hole section 110, for example, more difficult and require significant power as only the unexpanded proportion 210 is accessible to the contact portion 204. Similarly, detecting, pulling, receiving or extracting current from the formation via the open section 110 for receiving a signal, for example, will be power intensive as only the unexpanded proportion 210 is accessible to the contact portion 204. The apparatus 200 is configured to address, at least partially, these issues.

In operation, the expandable portion 202 expands to create contact between the contact portion 204 and an open hole surface of the open section. The expandable portion 202 forces the contact portion 204 into contact with an open hole surface of the open hole section 110. If the contact portion 204 is already in contact with the open hole surface of the open hole section 110, then expansion of the expandable portion 202 increases the amount of surface area of the open hole surface that the contact portion 204 contacts. As the expandable portion 202 expands the contact portion 204 contacts more and more of the open hole surface.

Figure 5:
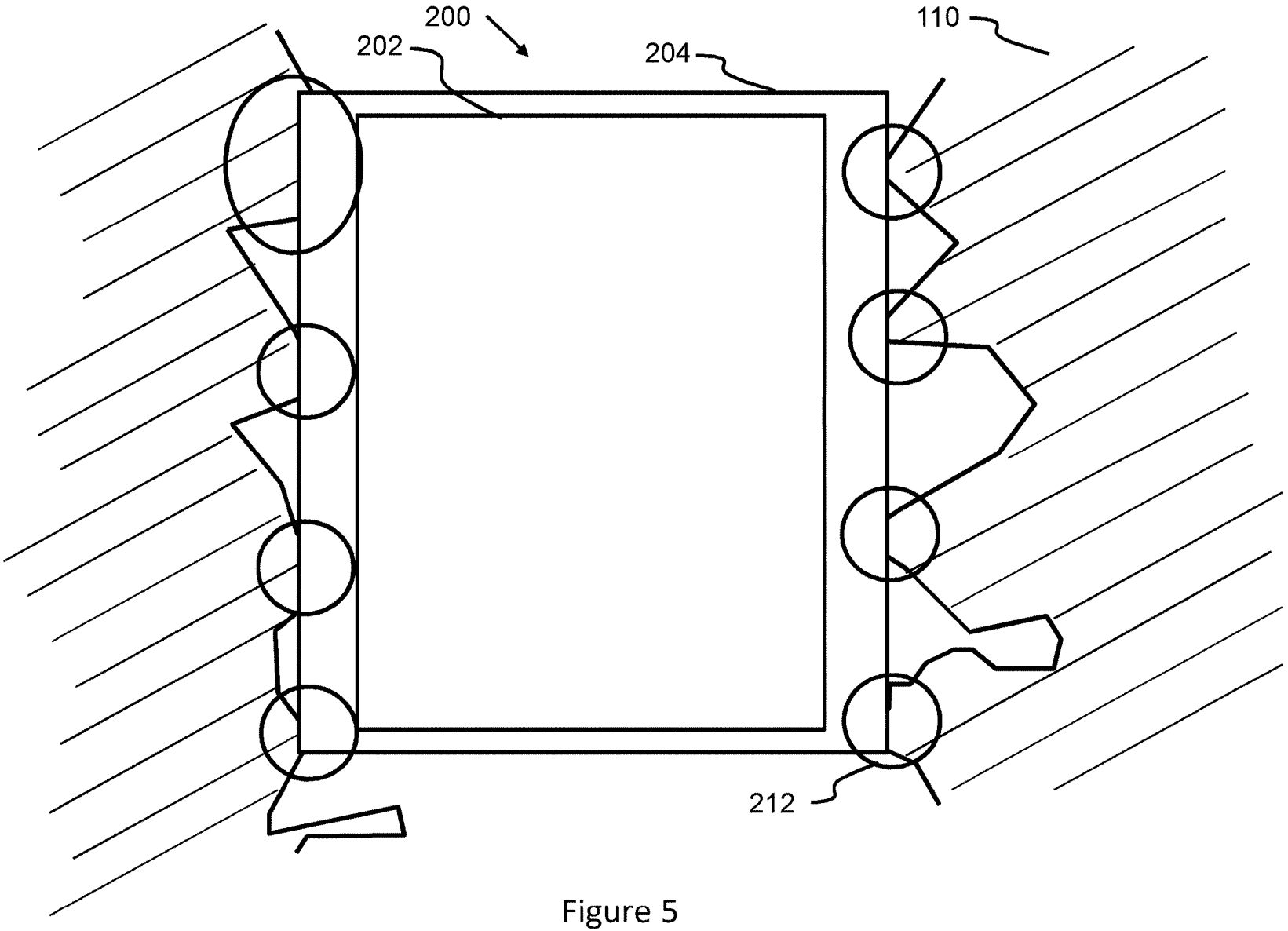
FIG. 5 is an enlarged elevation view of the open hole section of the well of FIG. 1 with the apparatus for contacting an open hole surface in an expanded state.

Turning now to FIG. 5, the apparatus 200 is shown with the expandable portion 202 expanded (i.e. in the expanded state). Expansion of the expandable portion 202 forces the contact portion 204 to contact a greater surface area of the open hole surface than when the expandable portion 202 is not expanded or in its resting state. This greater surface is highlighted in FIG. 5 and identified as expanded proportion 212. As will be appreciated, the expanded proportion 212 represents a greater surface area of the open hole surface than the unexpanded portion 210. Thus, upon expansion of the expandable portion 202, the contact portion 204 contacts a greater surface area of the open hole surface.

Contacting a greater surface area of the open hole surface minimizes resistance, specifically, resistance to ground, and allows more current to be pushed, transferred or transmitted into the open hole surface, or detected, pulsed or received from the open hole surface. This is advantageous when transmitting (transferring current) signals or receiving (detecting current) signals.

As shown in FIG. 5, a number of uneven or not smooth surfaces still exists on the open hole section 110 that the contact portion 204 is not contacting when the expandable portion 202 is expanded (i.e. in the expanded state). In one embodiment, an open hole surface of the open hole section 110 is scanned to determine the layout of open hole surface. The layout may include the specific geological features of the open hole surface such as the size and configuration including angles, lengths and widths of the uneven surface of the open hole surface. This may include the size and configuration of bumps, cracks, fractures, fissures and other geological features.

The apparatus 200 is configured, prior to placement within the open hole section 110, to maximize the surface area of the open hole surface contacted by the contact portion 204 when the expandable portion 202 is expanded based on the layout (from the scan, for example) of the open hole surface. The surface area of the open hole surface contacted by the contact portion 204 is accordingly maximized. Conversely the resistance (resistance to ground) seen by the contact portion 204 at the open hole surface is minimized since the surface area contacted is maximized.

Figure 6A:
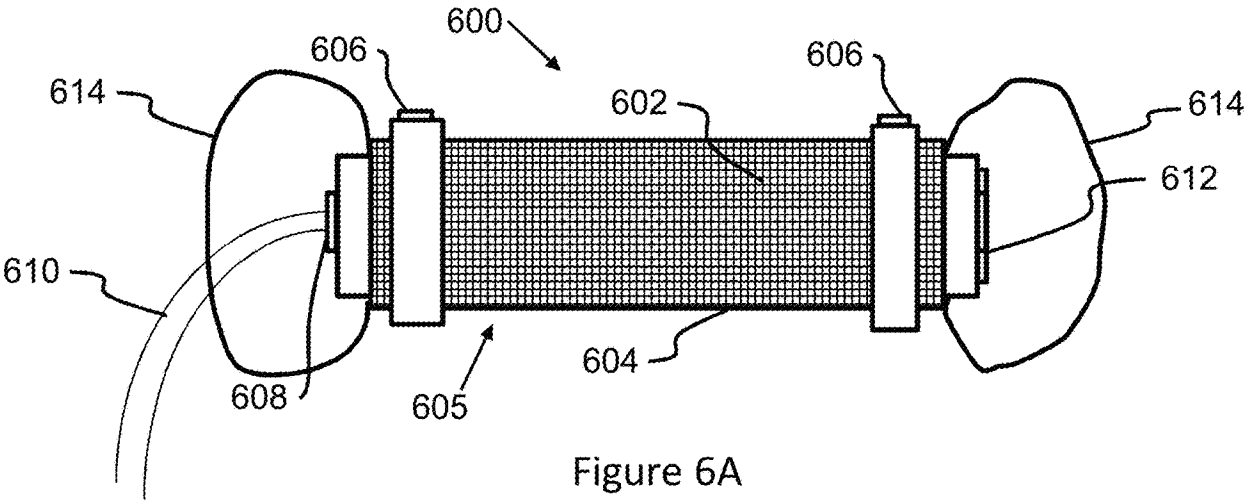
FIG. 6A is an elevation view of another embodiment of the apparatus of FIG. 4 in a resting or unexpanded state.
Figure 6B:
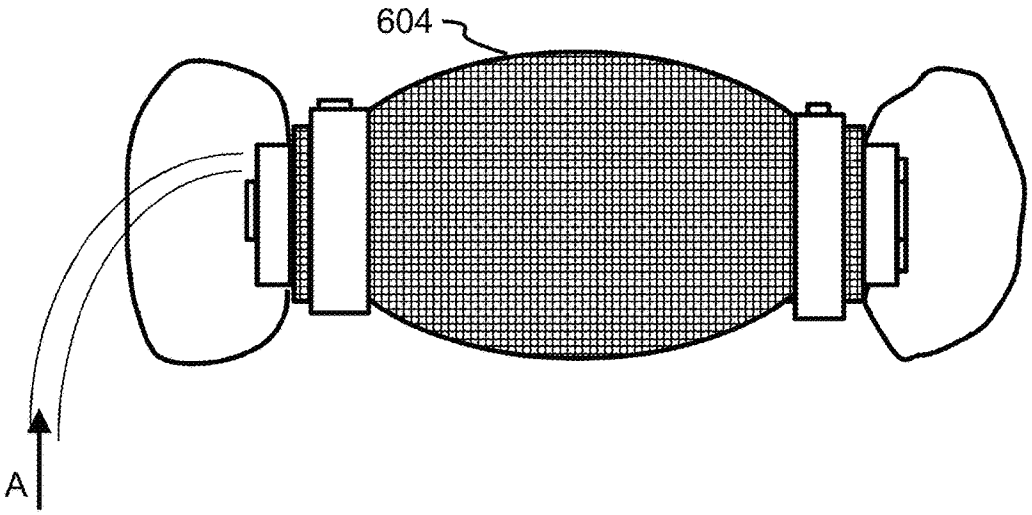
FIG. 6B is an elevation view of the apparatus of FIG. 6A in an expanded state.

While a particular apparatus 200 has been described, a person of ordinary skill in the art will appreciate that various configurations are possible. Turning now to FIGS. 6A and 6B, another embodiment of the apparatus for contacting an open hole surface is shown generally identified by reference numeral 600. The apparatus 600 comprises an expandable portion surrounded by a contact portion.

In this embodiment, the expandable portion comprises an inflatable bladder 602. The inflatable bladder 602 is configured to be inflated/pressurized to inflate and expand. In this embodiment, the inflatable bladder 602 is a tube. The tube is a rubber tube.

In this embodiment, the contact portion comprises a sleeve 604. The sleeve 604 is configured to contact an open hole surface upon expansion of the inflatable bladder 602. The sleeve 604 surrounds the inflatable bladder 602, although not the entirety of the inflatable bladder 602. The sleeve 604 may be in contact with the open hole surface prior to expansion of the inflatable bladder 602; however, expansion of the inflatable bladder 602 causes the sleeve 604 to contact a greater surface area of the open hole surface. As previously described, increasing the surface area of the open hole surface contacted by the sleeve 604 decreases the resistance (the resistance to ground) and allows for more current to be introduced into the formation via the open hope surface.

The sleeve 604 is electrically conductive such that the sleeve 604 can be used to push or pull current into or out of, respectively, the open hole surface. In this embodiment, the sleeve 604 is a mesh sleeve. The mesh comprises a tube of rope 605. The rope is electrically conductive. In this embodiment, the rope is metal rope, in particular, braided steel rope such that the mesh is a braided steel mesh sleeve.

In this embodiment, the apparatus 600 further comprises clamps 606, fitting 608, tubing 610 and plug 612. The clamps 606 are configured to secure the mesh 604 to the bladder 602. In this embodiment, there are two clamps 606, one clamp 606 secured to each longitudinal end of the mesh 604. The fitting 608 is secured to one end of the bladder 602 to secure the tubing 610 to the bladder 602. The fitting 608 prevents leakage of fluid (air or liquid) from the bladder 602 and allows for the inflatable bladder 602 to be inflated via the tubbing 610. The plug 612 is secured to the other end of the bladder 602 to prevent leakage of fluid from the bladder 602. In this embodiment, the plug 612 is a cap head screw plug. The tubing 610 runs from the bladder 602 to an air supply. In other embodiments, the tubing 610 runs from the bladder 602 to a liquid, gas or fluid supply.

In this embodiment, the apparatus 600 further comprises loops 614. In this embodiment, there are two loops 614. The loops 614 are secured to mesh 604, one secured to either longitudinal end of the mesh 604.

In use air (or other fluid) is pumped or otherwise sent through tubing 610 (in the direction A) into the inflatable bladder 602 to expand the bladder 602. The bladder 602 expands, as shown in FIG. 6B, to cause the sleeve 606 to contact an open hole surface.

While the expandable portion has been shown as comprising a single inflatable bladder 602, the expandable portion may comprise multiple inflatable bladders. In another embodiment, the expandable portion comprises an inflatable bladder at each longitudinal end of the apparatus 600.

Figure 7B:
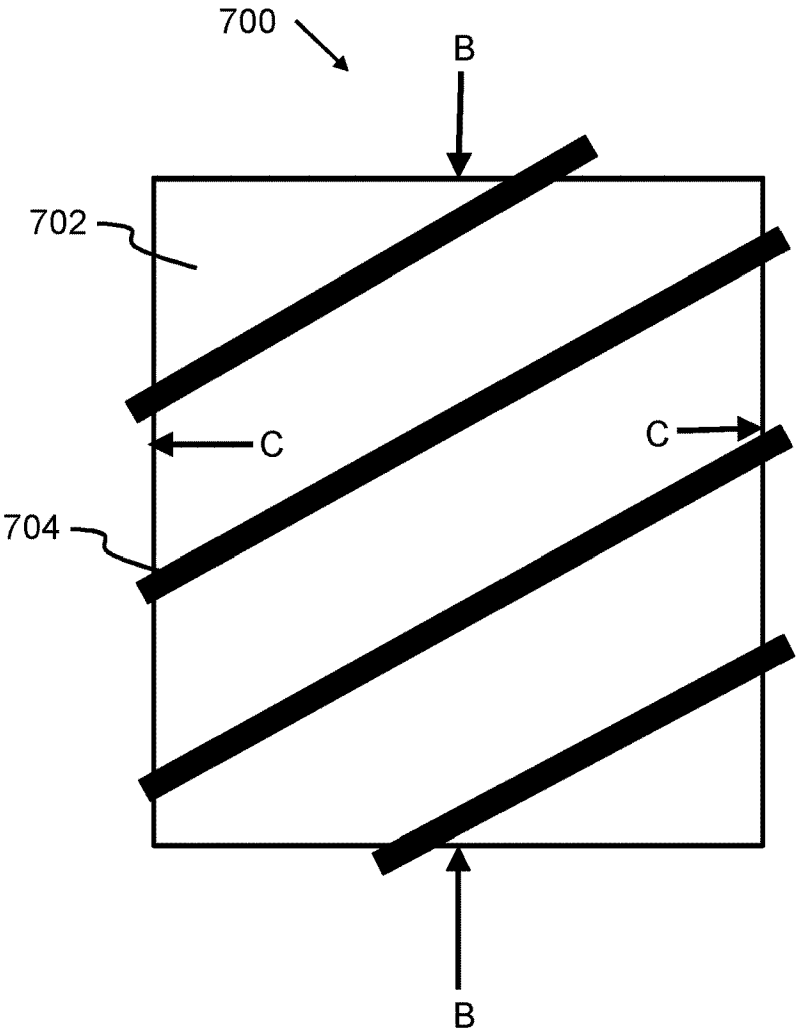
FIG. 7B is an elevation view of the apparatus of FIG. 7A in an expanded state.
Figure 7A:
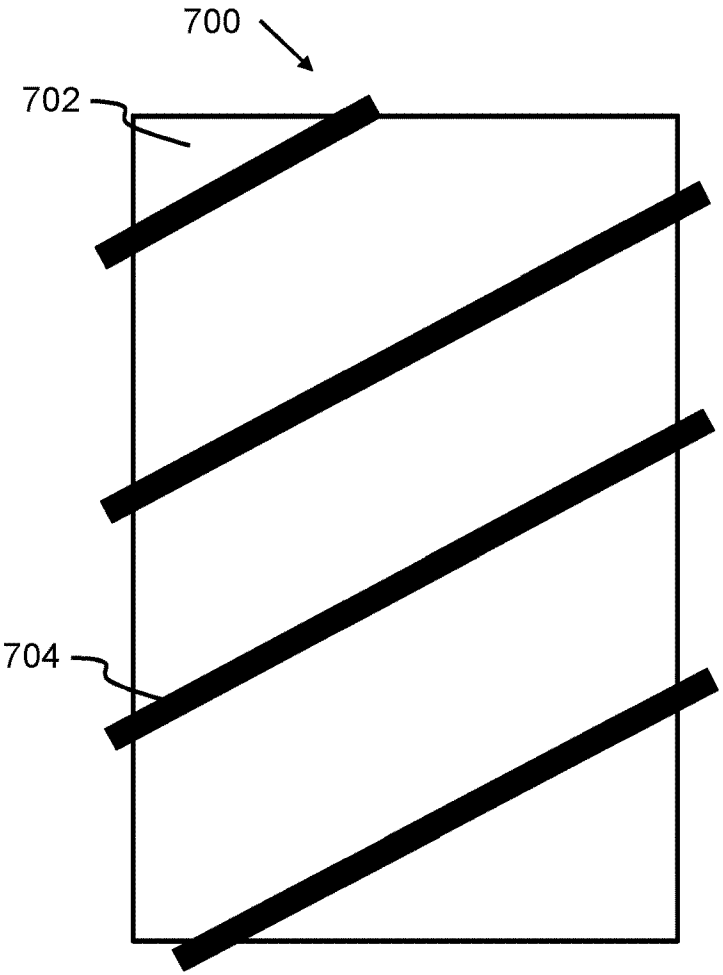
FIG. 7A is an elevation view of another embodiment of the apparatus of FIG. 4 in a resting or unexpanded state.

While apparatus have been described, a person of ordinary skill in the art will appreciate that various configurations are possible. Turning now to FIGS. 7A and 7B, another embodiment of the apparatus 700 for contacting an open hole surface is shown generally identified by reference numeral 700. The apparatus 700 comprises an expandable portion surrounded by a contact portion. The expandable portion comprises a member 702 configured to buckle outwards upon compression. The contact portion comprises sleeve 704 surrounding the member 702. The sleeve 704 is configured to contact the open hole surface upon compression and buckling of the member 702.

In this embodiment, the member 702 comprises tubing. The tubing is a polymer.

The sleeve 704 is elastic or otherwise deformable such that when the member 702 buckles outward, the sleeve 704 does not restrict buckling, but allows the buckling of the member 702. In this embodiment, the sleeve 704 is made from an electrically conductive material. When the member 702 is compressed the tubing buckles and a greater proportion or surface area of the open hole surface is contacted by the sleeve 704. The increased surface area allows for lower resistivity to be seen by the sleeve 704 when receiving or transmitting signals through the open hole surface from or into, respectively, the formation.

In operation, the member 702 is longitudinally compressed (i.e. compressed along its long axis) in direction B, as shown in FIG. 7B, such that member 702 is forced to buckle outwards (i.e. radially) in direction C by the compression. The sleeve 704 surrounds the member 702 such that the outwards buckling of the member 702 causes the sleeve 702 to contact the open hole surface. Thus, during compression of the member 702 an increased surface area of the open hole surface contacts the sleeve 704. Once the member 702 is no longer compressed, the member 702 returns to its original uncompressed and unbuckled state. The compression therefore decreases the height of the member 702, while the resultant buckling increases the width of the member 702.

In this embodiment, the member 702 is compressed on both ends. However, a person of ordinary skill in the art will appreciate that the member 702 may be compressed on only a single end.

In this embodiment, the member 702 may be compressed by a piston. The piston may be motor driven.

Figure 8:
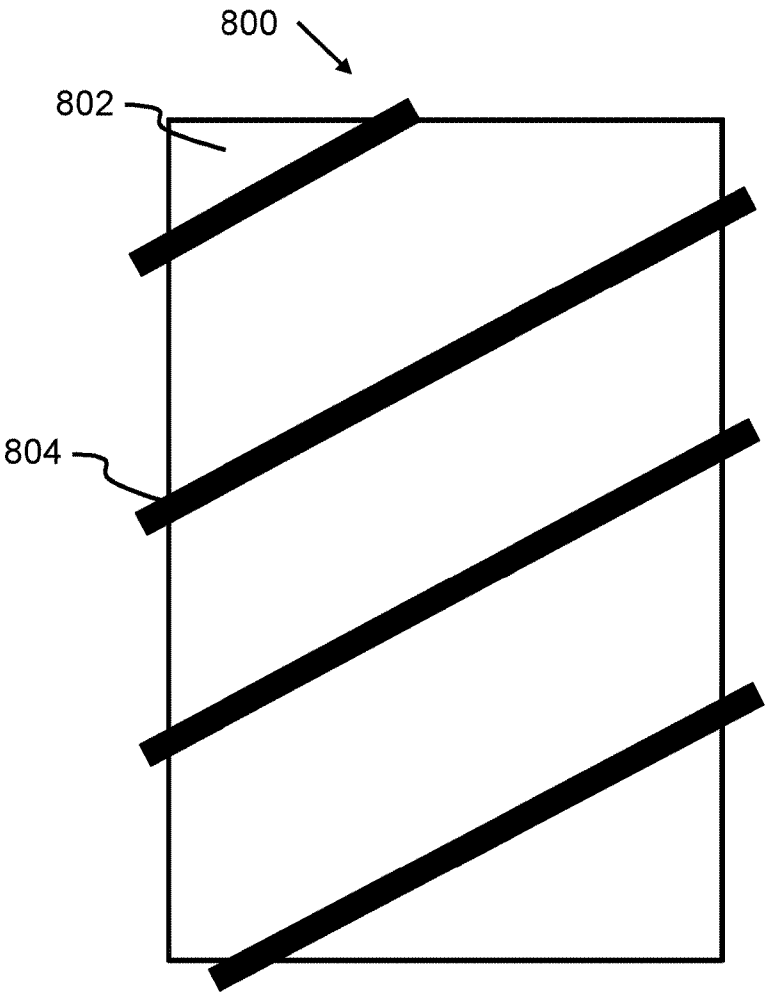
FIG. 8 is an elevation view of another embodiment of the apparatus of FIG. 4.

While apparatus have been described, a person of ordinary skill in the art will appreciate that various configurations are possible. Turning now to FIG. 8, another embodiment of the apparatus for contacting an open hole surface is shown generally identified by reference numeral 800. The apparatus 800 comprises an expandable portion surrounded by a contact portion. The contact portion is configured to contact an open hole surface.

In this embodiment, the expandable portion comprises a swellable member. In this embodiment, the swellable member comprises an elastomer 802 configured to swell on contact with a particular fluid. Exemplary fluids include water. Exemplary elastomers 802 include a superabsorbent polymer (SAP). The SAP is configured to swell upon contact with water.

In this embodiment, the contact portion comprises a sleeve 804. The sleeve 804 is elastic or otherwise deformable such that when the elastomer 802 swells, the sleeve 804 does not restrict swelling of the elastomer 802. In this embodiment, the sleeve 804 is made from an electrically conductive material. When the elastomer 802 swells a greater proportion or surface area of the open hole surface is contacted by the sleeve 804. Due to the increased surface area, lower resistivity is seen by the sleeve 804 when receiving or transmitting signals through the open hole surface from or into, respectively, the formation.

Despite the sleeve 804 surrounding the expandable portion, the fluid may still contact the elastomer 802. For example, the sleeve 804 may have gaps or apertures.

The elastomer 802 is configured to swell upon contact with a particular fluid to increase the diameter of the contact portion and increase the surface area of the open hole portion that is contacted by the sleeve 804. The particular fluid may be production fluid or a particular trigger injected into production or other fluid.

Figure 9B:
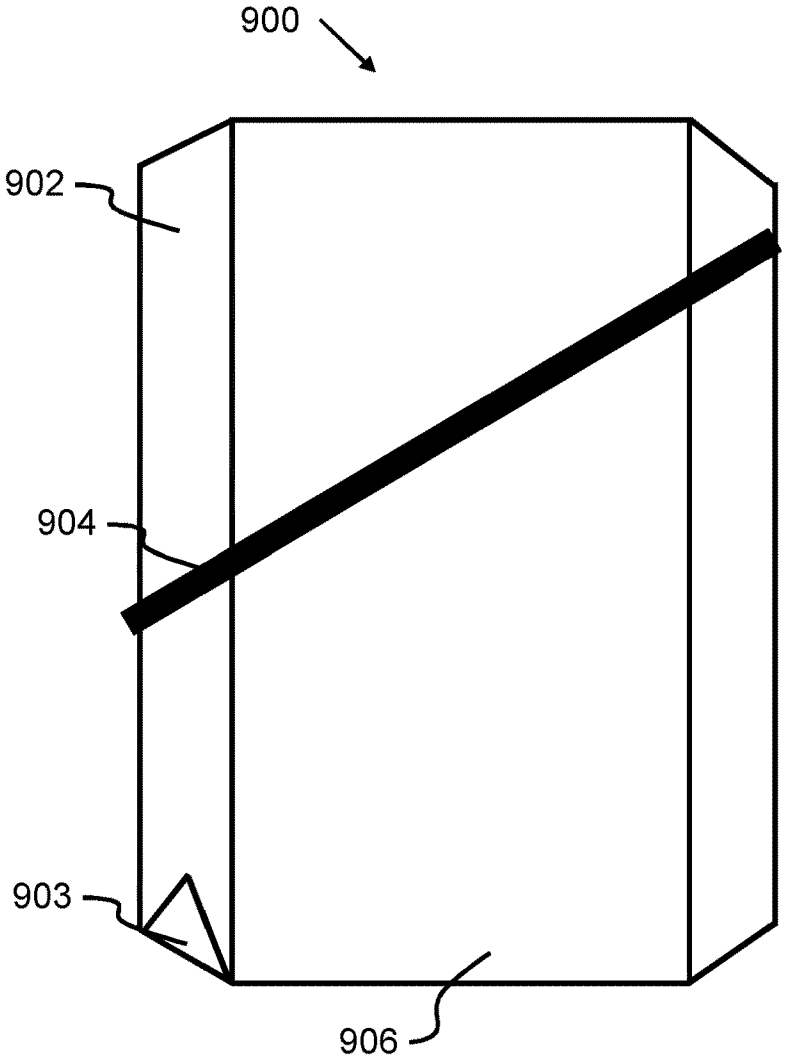
FIG. 9B is an elevation view of the apparatus of FIG. 9A in an expanded state
Figure 9A:
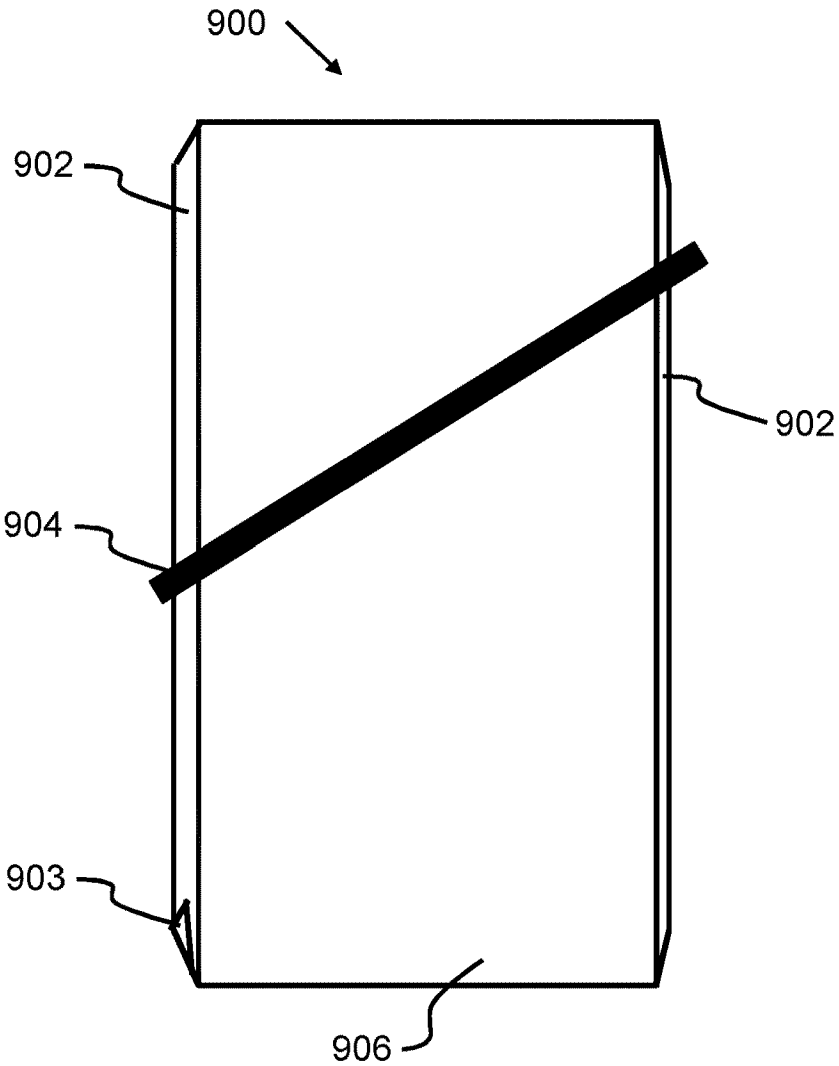
FIG. 9A is an elevation view of another embodiment of the apparatus of FIG. 4 in a resting or unexpanded state.

While apparatus have been described, a person of ordinary skill in the art will appreciate that various configurations are possible. Turning now to FIGS. 9A and 9B, another embodiment of the apparatus for contacting an open hole surface is shown generally identified by reference numeral 900. The apparatus 900 comprises an expandable portion surrounded by a contact portion.

In this embodiment, the expandable portion is configured to receive fluid. The fluid may be production fluid surrounding the apparatus 900. In this embodiment, the expandable portion comprises two pockets 902. Each pocket 902 is configured to receive fluid and expand.

The expandable portion further comprises two valves 903. One valve 903 is incorporated into each of the pockets 902. For clarity only one valve 903 is shown. Each valve 903 is configured to open to allow fluid into the respective pocket 902 to expand. Once the respective pocket 902 is fully expanded, each valve 903 is configured to close to prevent escape or release of fluid from the respective pocket 902. Each valve 903 is then configured to open to allow fluid to escape or be released from the respective pocket 902 as the apparatus 900 returns to its unexpanded or resting state. Each individual valve 903 may comprises multiple valves including dual non-return valves that are remotely controlled to allow fluid flow into a pocket 902 (but not out of the pocket 902), and that allow fluid flow out of a pocket 902 (but not into the pocket 902).

While two pockets 902 have been described, a person of ordinary skill in the art will appreciate that fewer or more may be used. Furthermore, while two valves 903 have been described, a person of ordinary skill in the art will appreciate that fewer or more may be used. In particular, each pocket 902 may have multiple valves 903 incorporated therein.

In this embodiment, the contact portion comprises a sleeve 904. Only a portion of the sleeve 904 is shown in FIGS. 9A and 9B for clarity. The sleeve 904 is elastic or otherwise deformable such that when the pockets 902 expand, the sleeve 904 does not restrict expansion of the pockets 902. In this embodiment, the sleeve 904 is made from an electrically conductive material. When the pocket 902 expands a greater proportion or surface area of the open hole surface is contacted by the sleeve 904. The increased surface area allows for lower resistivity to be seen by the sleeve 904 when receiving or transmitting signals through the open hole surface from or into, respectively, the formation.

In operation, the apparatus 200 is shown in its resting state or unexpanded state in FIG. 9A. When expansion is desired, one or more valves 903 is opened an fluid flows into one or more of the valves 903 to expand the pockets 902. The pockets 902 expand as shown in FIG. 9B due to the increased fluid pressure from the fluid that enters through the valves 903. Once the pockets 902 are sufficiently or fully expanded, the valves 903 close to prevent flow escape or release from the pockets 902. The apparatus is then in its expanded state as shown in FIG. 9B. The sleeve 904 then contacts an increased surface area of the open hole surface.

To return the apparatus 900 to its resting or unexpanded state, the valves 903 are opened to allow fluid to escape or be released from the pockets 902. Once the apparatus 900 has returned to its resting or unexpanded state as shown in FIG. 9A, the valves 903 are closed to prevent fluid flow into the pockets 902.

In another embodiment, the apparatus 900 further comprises hollow central portion 906. Production or other fluid may flow through the central portion 906. The valves 903 may be positioned and configured such that fluid flows from the central portion 906 into the valves 903, and fluid flows from the valves 903 into the central portion 906.

While particular configurations of apparatus for contacting an open hole surface have been described, a person skilled in the art will appreciate that variations are possible. In another embodiment, any of the described apparatus may be configured to at least one of transmit and receive a signal. Specifically, the apparatus may be configured to transmit an electrical signal through the formation via the open hole surface and/or receive an electrically signal transmitted through the formation via the open hole surface.

While particular configurations of apparatus for contacting an open hole surface have been described, a person skilled in the art will appreciate that variations are possible. In another embodiment, any of the described apparatus may be configured for use in a sidetrack of a well. A sidetrack is a secondary wellbore drilled away from the original well. It is possible to have multiple sidetracks, each of which may have been drilled for different reasons. The sidetrack may be unused. Specifically, the sidetrack may be unused for collecting production fluid. Use of the apparatus in a sidetrack that is not used for collecting production fluid ensures that the apparatus does not restrict the flow and/or collection of production fluid.

In other embodiments, prior to expanding the expandable portions of the described apparatus, the apparatus, specifically, the expandable portion surrounded by the contact portion, may be passed through a well to an open hole surface. The apparatus is sized such that the radius of the apparatus is smaller than the radius of the well. As the expandable portion has not been expanded, the radius of the apparatus allows for passing the apparatus through the well to the open hope surface. The allows for the apparatus to be placed downhole of the mouth of the well and still be expandable to contact the open hole surface.

The applicant discloses in isolation each individual feature described herein and any combination of two or more such features, to the extent that such features or combinations are capable of being carried out based on the specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the scope of the invention.

The invention claimed is:

1. An apparatus for contacting an open hole surface within a subterranean extending well, the apparatus comprising:

an inflatable bladder; and an electrically conductive sleeve;

wherein the electrically conductive sleeve is disposed radially outside of the inflatable bladder and circumferentially surrounds the inflatable bladder;

wherein the apparatus is configured to be disposed in a rest state with the inflatable bladder disposed at a first diameter or in an expanded state with the inflatable bladder disposed at a second diameter, wherein the second diameter is larger than the first diameter;

wherein in the expanded state the apparatus is configured to create electrical contact between the electrically conductive sleeve and the open hole surface of the subterranean extending well for electrical conduction of electrical signals to and from the open hole surface of the subterranean extending well.

2. The apparatus of claim 1, wherein the electrically conductive sleeve comprises a braided steel mesh sleeve.

3. The apparatus of claim 1, wherein the electrically conductive sleeve comprises a mesh.

4. A method for contacting an open hole surface within a subterranean extending well, the method comprising:

providing an apparatus comprising an inflatable bladder and an electrically conductive sleeve, wherein the electrically conductive sleeve is disposed radially outside of the inflatable bladder and circumferentially surrounds the inflatable bladder, and wherein the apparatus is configured to be disposed in a rest state with the inflatable bladder disposed at a first diameter or in an expanded state with the inflatable bladder disposed at a second diameter, wherein the second diameter is larger than the first diameter;

disposing the apparatus in the rest state within a subterranean extending well at a position contiguous with an open hole surface of the subterranean extending well creating electrical contact between the electrically conductive sleeve of the apparatus and the open hole surface by expanding the apparatus from the rest state to the expanded state; and transmitting electrical signals to the open hole surface through the electrically conductive sleeve, or receiving electrical signals from the open hole surface through the electrically conductive sleeve, or both.

5. The method of claim 4, wherein the step of expanding the apparatus from the rest state to the expanded state includes pumping a fluid into the inflatable bladder.

6. The method of claim 4, wherein the fluid is a production fluid.

* * * * *